United States Patent [19]

Strang

[11] Patent Number: 4,504,813

[45] Date of Patent: Mar. 12, 1985

[54] ENERGY SAVING WOUND CORE TRANSFORMER

[75] Inventor: Donald P. Strang, Zanesville, Ohio

[73] Assignee: McGraw-Edison Company, Rolling Meadows, Ill.

[21] Appl. No.: 446,556

[22] Filed: Dec. 3, 1982

[51] Int. Cl.[3] ..... H01F 27/24

[52] U.S. Cl. ..... 336/216; 336/213

[58] Field of Search ..... 336/211, 213, 216, 217, 336/212

[56] References Cited

U.S. PATENT DOCUMENTS

| | | | |
|---|---|---|---|
| 1,933,140 | 10/1933 | Gakle | 336/211 |
| 2,892,169 | 6/1959 | Teague et al. | 336/213 |
| 2,968,862 | 1/1961 | Smith | 29/155.7 |
| 2,995,720 | 8/1961 | Smith | 336/217 |
| 3,104,364 | 9/1963 | Richardson | 336/213 |
| 3,303,449 | 2/1967 | Stimler | 336/213 |
| 3,818,587 | 6/1974 | Williams | 29/606 |
| 4,241,324 | 12/1980 | Douglass et al. | 336/217 |

FOREIGN PATENT DOCUMENTS

| | | | |
|---|---|---|---|
| 1023135 | 1/1958 | Fed. Rep. of Germany | 336/217 |
| 1100710 | 9/1955 | France . | |

*Primary Examiner*—A. D. Pellinen
*Assistant Examiner*—Susan A. Steward
*Attorney, Agent, or Firm*—Jon Carl Gealow; James A. Gabala; Hugh M. Gilroy

[57] ABSTRACT

A wound core transformer is described which features low core losses by the addition of magnetic material in those sides of the wound core which are located outside of the coil. In one embodiment the wound core includes: a base-core is formed from two strips of magnetic material of generally uniform thickness and wrapped about each other in the form of a closed rectangular loop with the ends of each strip offset from each other and the ends of the adjacent strip; and a filler strip of magnetic material which is interleafed between the two strips forming the base-core with its base disposed adjacent the ends of the strips forming the base-core. An electrical conductor is disposed opposite the filler strip and wrapped about the two strips forming the base core so as to form a coil. Under this arrangement, the magnetic induction formed in that side of core containing the base portion of the filler strip is lower than that side of the core around which the coil is wrapped.

6 Claims, 9 Drawing Figures

FIG. 3A
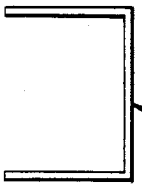
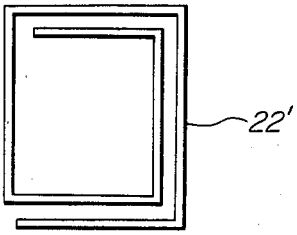
FIG. 3B
FIG. 1
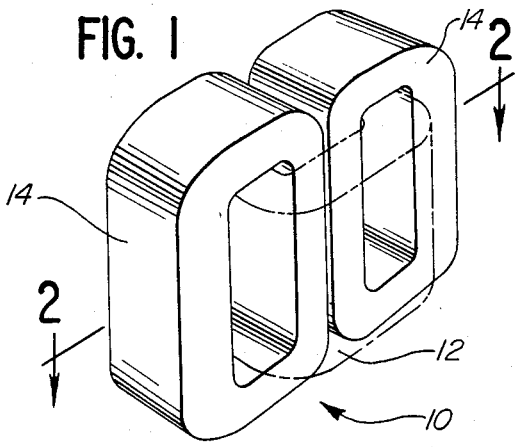
FIG. 4A
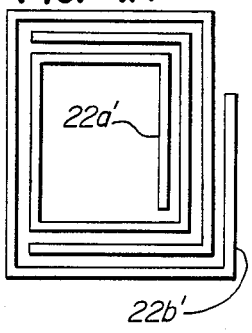
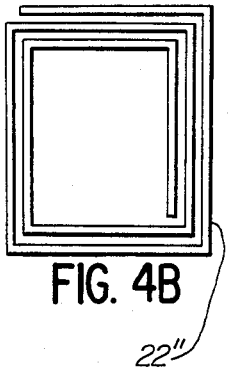
FIG. 4B
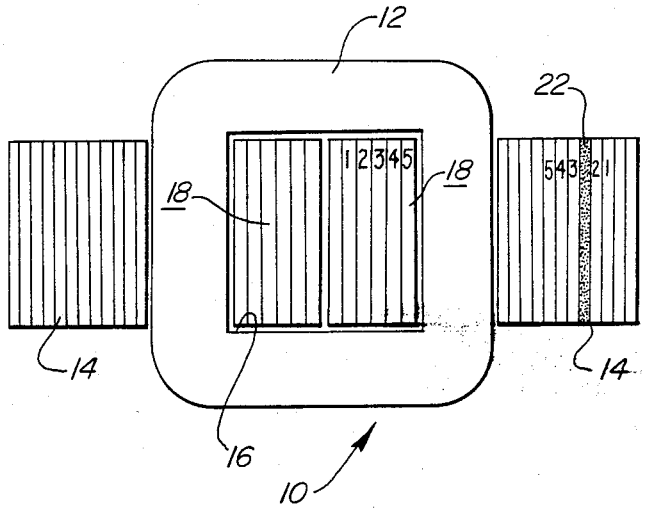
FIG. 2
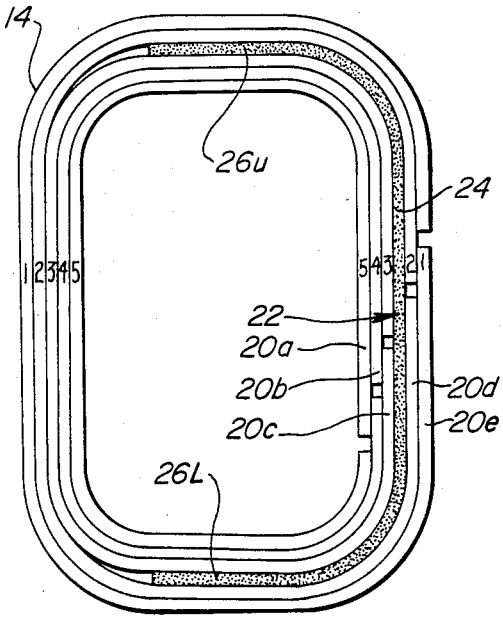
FIG. 3
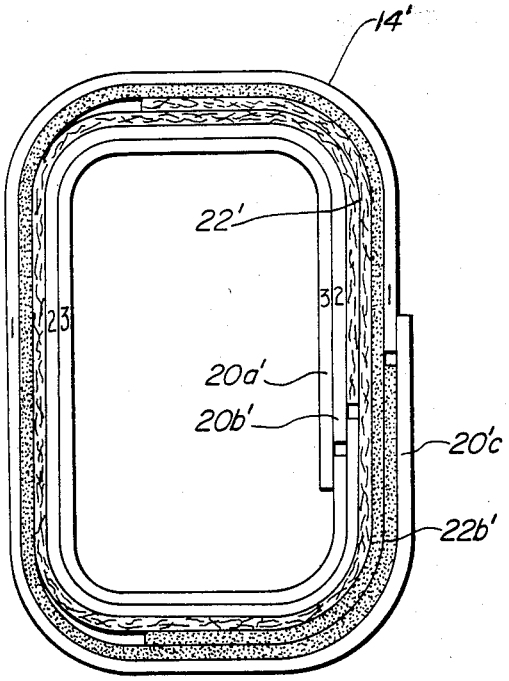
FIG. 4

ENERGY SAVING WOUND CORE TRANSFORMER

FIELD OF INVENTION

This invention relates, in general, to electrical transformers and, more particularly, to the magnetic core structure of wound core transformers.

BACKGROUND OF THE INVENTION

Present energy costs have forced utilities to take a new look at the way in which they evaluate transformer losses. Braunstein, "The Way You Buy Transformers Affects the Price", *Electrical World,* July 1982, pg. 123. The evaluation of bids for transformers is an involved study encompassing many facets of engineering economics. When all factors are evaluated and tabulated, it is common to find that the lowest-priced item will cost more than the others in the long run. It is common, for example, to find that transformer losses will cost more over the life of the transformer than the original price of the transformer. Chartier, "The Economics of Major Equipment Evaluation", *The Line* 74-2 (1974) page 20. Thus, transformer losses frequently become the most significant factor in the buying decision. A change in a few percent can spell the difference between a successful bid and a rejected bid.

The transformer industry in the United States is highly developed. There have been few major breakthroughs over the last ten years or so. This does not mean that there is no need for improvement or that further improvement cannot be made. However mature and sophisticated the design of transformers may be, the problem of finding an optimum design is far from obvious. The engineer is often faced with conflicting alternatives and limited choices.

The design of successful commercial transformers requires the selection of a simple structure or form, so that the conductor coils and insulation are easy to wind and the magnetic (iron) circuit is easy to build. At the same time, the mean length of the coil windings and the magnetic circuit must be as short as possible for a given cross sectional area so that the amount of material required and the losses are kept as low as possible. It is also desirable to operate at the highest flux density consistant with low losses in order to reduce the amount of iron and conductor. Two basic designs have emerged from these considerations.

When the magnetic circuit takes the form of a single ring encircled by two or more groups of primary and secondary windings distributed around the periphery of the ring, the transformer is termed a core-type transformer. When the primary and secondary windings take the form of a common ring which is encircled by two or more rings of magnetic material distributed around its periphery, the transformer is termed a shell-type transformer. One characteristic feature of the shell-type transformer is the short mean length of the magnetic circuit and the relatively long mean length of the windings. Because of these differences in shape and form, design improvements to one are not necessarily adaptable to the other.

As another example of the difficulty facing the transformer engineer, consider what might be done to reduce the iron loss (no-load loss). The simplest solution is to reduce the voltage and leave the physical design the same. Since the iron loss will decrease approximately as the square of the voltage, one needs only to reduce the voltage by 5% to get a 10% reduction in loss. However practical this solution may be at first sight, one must realize that a 5% reduction in voltage is accompanied by a 5% loss in the effective transformer capacity. Furthermore, the load loss in percent of this reduced rating has increased by 5%! Thus, one ends up sacrificing transformer capacity and increasing the per unit load loss by about half the percentage of reduction in the no-load loss.

It is conventional wisdom that iron loss will vary with the weight of the iron. Thus, another approach to lower no-load loss is to change the physical design of the transformer to reduce the cross-section of the iron core, while increasing the number of conductor turns in the coil to keep the flux density constant. If this is done, the core window opening will have to be increased to accommodate the higher number of turns, but there may still be a substantial decrease in the weight of the core and the consequent no-load loss. The conductor loss (or load loss), however, will increase with the number of turns. For example, if one reduces the cross-section of the core by 5% and increases the turns in the coil by 5%, one can expect to obtain about a 5% reduction in core loss, but at the cost of an increase of about 5% in the load loss. Moreover, the reactance will increase nearly in proportion to the square of the turns, or in this case by about 10%. Therefore, reducing the core section and increasing the turns have the effect of: reducing the no-load loss by the percentage amount that the load loss increases; increasing the total loss (if the load loss was originally greater than the no-load loss); increasing the reactance; and decreasing the weight of iron by approximately the same percentage amount that the weight of conductor increases. Simply stated, low reactance does not necessarily go with high load loss or low iron loss; similarly high reactance does not necessarily go with low load loss. In fact, it is generally considered to be unreasonably expensive to try to design for a low iron loss and low reactance in the same transformer. Yet, low reactance is a real advantage in a distribution transformer, because it is necessary to have the lowest possible regulation in these transformers. One author concludes that: If low iron loss is important, it will be more economical to use as small a transformer as possible, and to load it (high load loss) as heavily as possible using forced cooling; and if load loss is important it may be more economical to simply use a larger transformer (high no-load loss). Bean, *Transformers for the Electric Power Industry,* McGraw-Hill Book Company, Inc. (1959)

However good this recommendation may be, the typical distribution transformer (particularly the pole-mounted transformer in the 5-to-167-KVA range) is lightly loaded for an appreciable portion of the 24-hour day. Because of this, the loss in the core is a significant portion of the total daily loss. Cores for these units are, therefore, designed for low exciting current (low reluctance) and for relatively low core loss to minimize the operating cost. Fink, *Standard Handbook for Electrical Engineers,* Eleventh Edition, Section 10, Paragraph 158. Thus, for distribution transformers, no-load losses are important and a design that lowers core losses by increasing the mass of iron in the core without increasing the reactance and load losses is by no means obvious. It should be equally clear that those principles which apply to large power transformers do not necessarily apply to small distribution transformers.

From the foregoing, it should be appreciated that the design of transformers, and distribution transformers in particular, still leaves room for improvement. An improved distribution transformer which would allow one to reduce the core losses by an amount in excess of what the gain would be in the size of the core, and without having a proportional effect on the reactance of the transformer and without increasing the load loss, would go far in achieving the ultimate in a distribution transformer. It would also have the advantage of satisfying the continued long-felt need, by utilities and other purchasers of distribution transformers, in reducing life-cycle costs. Finally, if this energy saving improvement could be easily and readily adapted to existing transformer designs, the improved transformer could be made available quickly to customers, and without developing special equipment or procedures, or extensive capital investment. Heretofore, no one distribution transformer design, particularly one of the wound core design, has been able to achieve these advantages and features in a simple construction.

SUMMARY OF THE INVENTION

In accordance with the present invention a unique laminated transformer core is described which features lower core losses than that of a conventional design without a corresponding increase in load loss. In particular, a wound core transformer is described which includes a base-core formed from two strips of magnetic material of generally uniform thickness, and at least one filler strip. One of the strips of the base-core is shaped in a substantially closed, generally rectangular loop so as to define an inner surface and an outer surface. The second strip of the base-core is wrapped about the outer surface of the first strip in a substantially closed, generally rectangular loop with its ends offset a spaced distance from each other and from the ends of the first strip. The filler strip is also formed from magnetic material. It is interleaved between the two strips forming the base-core with the ends of the base-core strips disposed along the base of the filler strip. An electrical conductor is then wrapped about that side of the wound core opposite to that of the base of the filler strip so as to form a coil. Since that side of the wound core containing the base of the filler strip is thicker than that side of the wound core surrounded by the coil, the magnetic induction formed in that side of the wound core containing the base of the filler strip is lower than the induction in that side of the wound core around which the conductor is wrapped when the coil is energized. Preferably the filler strip is of sufficient length so that it occupies the three sides of the wound core that are disposed outside of the coil, whereby the three thickest sides of the composite laminated wound core, which includes the base-core and the filler strip, are disposed outside of the coil and the magnetic induction formed in the three thickest sides is lower than that of the remaining side when the coil is energized. In the case of a wound core of generally rectangular cross section, the filler strip, in its simplest embodiment, is U-shaped.

In another embodiment of the invention the filler strip is formed from two strips of magnetic material of generally uniform thickness which are wrapped about each other so as to form a filler strip of non-uniform thickness. Specifically, the first strip is wrapped about itself so as to form a substantially closed, generally rectangular loop having its ends substantially overlapping each other, with one of its ends disposed opposite the center axis of the coil and with its other end generally at right angles to the center axis of the coil. The second strip is wrapped about itself and the first strip so as to form a substantially closed, generally rectangular loop with its ends substantially overlapping each other, with one of its ends disposed opposite the center axis of the coil and with its other end disposed generally opposite to the other end of the first strip (i.e., generally at right angles to the center axis of the coil on the other side of the transformer core thereformed). In this embodiment the three thickest sides of the transformer core formed by the base core and the two filler strips are disposed outside of the coil and the magnetic induction formed in the three thickest sides upon the energization of the conductor or coil is lower than that of the remaining side (i.e., the one around which the coil is wrapped).

Significantly, it has been observed that despite the insertion of extra magnetic material into the base core, the percent reduction in core losses exceeds the percent increase in core material. Other advantages and features of the invention will become readily apparent from the following detailed description of the invention, the embodiments thereof, from the claims, and from the accompanying drawings.

BRIEF DESCRIPTION OF THE DRAWINGS

In order that the invention may be clearly understood and readily carried into effect, devices in accordance therewith will now be described by way of example, with reference to the accompanying drawings in which:

FIG. 1 is a perspective view of an electromagnetic induction apparatus, such as a wound-core transformer, having a winding and two wound iron cores which are formed according to my invention;

FIG. 2 is a cross sectional view of the transformer illustrated in FIG. 1 as viewed along a reference plane 2—2;

FIG. 3 is a side elevational view of a representative portion of one of the cores shown in FIG. 1;

FIG. 3*a* is a diagramatic representation of the filler strip shown in FIG. 3;

FIG. 3*b* illustrates still another embodiment;

FIG. 4 is a side elevational view of a portion of the core shown in FIG. 1, illustrating a second embodiment of the invention;

FIG. 4*a* is a diagramatic representation of the filler strips shown in FIG. 4;

FIG. 4*b* illustrates yet another embodiment; and

DETAIL OF THE PREFERRED EMBODIMENTS

Figure 5:
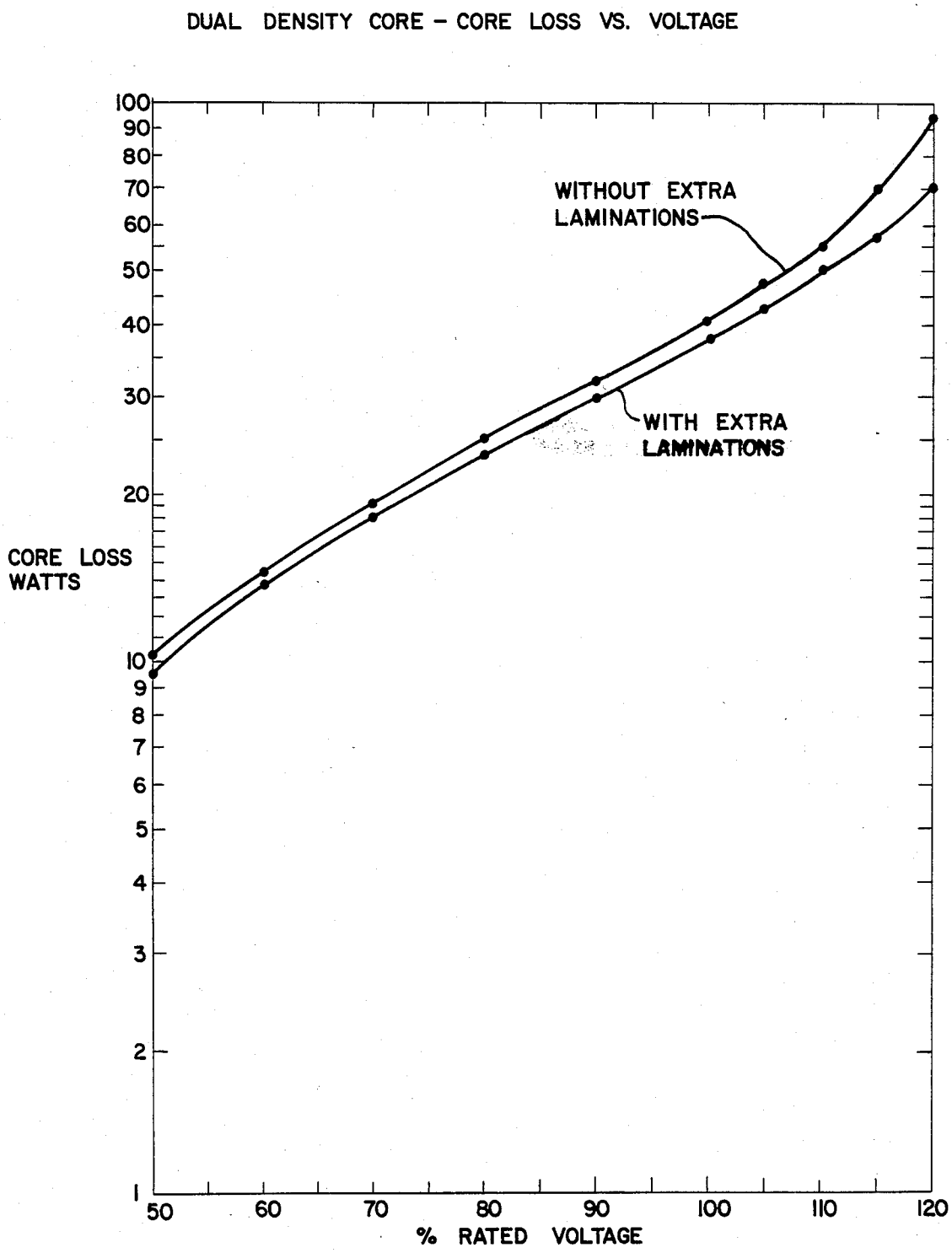
FIG. 5 is a graph illustrating core losses vs. voltage for an ordinary core and for one following the principles of my invention.

While this invention is susceptable of embodiment in many different forms, there is shown in the drawings and will herein be described in detail two preferred embodiments of the invention. It should be understood, however, that the present disclosure is to be considered an exemplification of the principles of the invention and is not intended to limit the invention to the specificate embodiments illustrated.

Turning to the drawings, FIG. 1, illustrates a shell-type transformer 10 consisting of a coil winding 12 (shown in phantom to better illustrate the unique concept of the invention) and two laminated wound magnetic cores 14. It should be understood that the cores 14 and coil 12 may be of any cross section and shape. Here they are shown with a quadangular cross section-either square or rectangular having rounded-off corners (See FIG. 2). The cores 14 form a closed path around the coil winding 12 of the transformer 10. The wound coil 12 as such forms a rectangular window 16 into which two legs or sides 18 of the two rectangular cores 14 are snugly fitted.

Turning now to FIG. 3, it should be understood that each core 14 is formed from a plurality of individual strips or laminations of suitable sheet material having high permeability favoring flow of magnetic flux in a direction running lengthwise of the strip. As many of these strips are pre-cut to length as required for building the core of the desired thickness and number of laminations. Each strip is of a length sufficient for it to be wrapped about the coil 12 through one turn. In the embodiment illustrated in FIG. 3, the core 14 is formed from a base-core comprising five concentrically wound strips 20*a*, 20*b*, 20*c*, 20*d*, and 20*e* and from an interleafed U-shaped filler strip 22. In FIG. 4, the base-core 14' is formed from three concentrically wound strips 20*a'*, 20*b'*, and 20*c'* and from an interleafed pair of filler strips 22*a'*, and 22*b'*. In FIG. 3, the ends of each strip forming the base-core abutt one another with small gaps and with ends of adjacent strips at a spaced distance apart from each other. The abutting ends of each of the five strips forming the base-core are disposed on one side (the right side according to the orientation shown in FIG. 3) of the base-core and staggered from each other so as to form an echelon. In FIG. 4, the ends of each strip forming the base-core slightly overlap eachother such that one of each strip abuts one end of the adjacent strip (i.e., the outer end of strip 20*a'* abuts the inner end of strip 20*b'*). Just as in the embodiment illustrated in FIG. 3, the ends of the strips forming the base-core are on one side (the right-hand side according to the orientation illustrated in FIG. 4) of the base-core and are staggered from each other so as to form an echelon.

In FIG. 3, the filler strip 22 is U-shaped so as to define a base portion 24 and two oppositely disposed legs 26L and 26U generally at right angles to the base portion 24. The base portion of the filler strip 22 is on that side of the base-core across which the ends of the individual strips 20*a*, 20*b*, 20*c*, 20*e*, and 20*d* are staggered. Thus, a core 14 is formed which has three sides which are thicker than the remaining side. The thicker sides are disposed outside of the coil window 16. Thus, when the coil 12 is energized, the magnetic induction in the core 14 is lower in the three sides disposed outside of the coil window. In FIG. 3*b* a substantially longer filler strip 22' is illustrated which achieves the same effect of a U-shaped filler strip 22. Thus, the filler strip can be longer or shorter than the base-core strips.

Turning to FIG. 4, each of the two filler strips 22*a'* and 22*b'* is formed from a strip of magnetic material which is generally longer in length than the strips 22*a'*, 22*b'* and 22*c'* which form the base-core. Each filler strip 22*a'* or 22*b'* has its ends substantially overlapping each other with one of its ends disposed along that side of the core to which the ends of the base-core strips 20*a'*, 20*b'*, and 20*c'* are disposed (i.e., the right-hand side using the orientation of FIG. 4). The opposite end of each of the two filler strips 22*a'* and 22*b'* is disposed generally at right angles to that side of the core 14' containing the overlapping ends of the base-core strips (i.e., one end at the top and one at the bottom). FIG. 4*a* is a simplified diagram of the manner in which the two filler strips 22*a'* and 22*b'* are wrapped about each other. Since each filler strip has one end disposed along that side of the core (i.e., the right hand side) containing the ends of the base-core strips, that side of the core 14' thereformed and the two adjacent sides (i.e., the upper side and the lower side), are thicker than that side of the core disposed within the coil window 18. Thus, when the coil 12 is energized, the magnetic induction in those sides disposed outside of the coil window 16 is less than that of the side disposed within the coil window. FIG. 4*a* diagrams the filler strips 22*a'* and 22*b'* shown in FIG. 4. In FIG. 4*b* a one piece filler strip 22' is illustrated having the same effect in varying the thickness of the sides of the core thereformed. Thus, one or two strips can be used for the filler strip.

In one specific embodiment, a wound-core was formed from about 168 full strips (each 0.011 inches thick, grade M-4) of oriented silicon steel and one filler strip of the same material for every 10 full strips much as that illustrated in FIG. 3. The thickness of the leg without filler strips was about 1.625 inches and the thickness of the leg with filler strips was 1.78 inches. The core weight was 84½ lbs. A core was assembled using a pre-wound coil on the leg without filler strips, the coil was energized at various voltages, and the core loss was measured with a precision wattmeter. The results are illustrated in FIG. 5 (i.e., the curve labeled "with extra laminations"). 100% rated voltage corresponded to an induction of 15.9 kilogauss in the leg without filler strips. Next, the filler strips were removed, reducing the core weight to 80 lbs. Tests on the core without filler strips resulted in the curve labeled "without extra laminations" in FIG. 5. It can be seen that the use of filler strips decreased the core loss by three watts at 100% voltage, corresponding to 7.3% reduction, while the weight increased by only 5.6%. Thus, a significant reduction in core loss was achieved without increasing the size of the leg around which the coil is wound. Significantly, it was also discovered that the filler strips are effective in reducing the core loss only if they are inserted in the leg which contains the ends of the full strips. Apparently the extra reluctance of the gaps in the full strips forces the magnetic induction into the filler strips.

From the foregoing, it will be observed that numerous variations and modifications may be affected without departing from the true spirit and scope of the novel concept of the invention. For example, although two specific embodiments of the filler strip have been illustrated and described in detail, the filler strip may assume the form of a simple flat lamination disposed on that side of the core opposite the coil. It should be understood that no limitations with respect to the specificate apparatus illustrated herein is intended or should be inferred. It is, of course, intended to cover by the appended claims all such modifications as fall within the scope of the claims.

What is claimed is as follows:

1. A magnetic core for a transformer, comprising:

(a) a first strip of magnetic material shaped in a substantially closed loop of one turn so as to define an interior surface and an exterior surface and two abutting ends;

(b) a second strip of magnetic material, generally equal in length to said first strip and wrapped about the exterior surface of said first strip, defining two abutting ends which are laterally offset from the abutting ends of the first strip; and (c) a third strip of magnetic material, interleafed between said first strip and said second strip, defining two ends which are substantially spaced apart from one another with the abutting ends of said first strip and the abutting ends of said second strip disposed intermediate the ends of said third strip, said third strip having a length such that the transverse thickness of the side of the core thereformed which is opposite the ends of said first strip and said second strip is thinner than the remaining three sides.

2. The magnetic core set forth in claim 1, wherein said first strip and said second strip are each bent at four points intermediate their abutting ends so as to form a generally closed rectangular hollow structure defining four sides, the transverse thickness of which are generally equal with one of said sides having the abutting ends of said first strip and said second strip, and wherein said third strip is bent at two points intermediate its ends so as to form a generally U-shaped strip defining three legs which are proportional in length to three of the four sides defined by said first strip and said second strip with that leg intermediate the ends of said third strip being disposed adjacent said one side of the closed rectangular hollow structure formed by said first strip and said second strip, whereby a generally rectangular magnetic core is formed with a side having a thickness less than that of the remaining three sides.

3. The magnetic core set forth in claim 1, wherein said third strip is shorter than said first strip and said second strip.

4. The magnetic core set forth in claim 1, wherein said third strip is longer than said first strip and said second strip.

5. A laminated transformer core, comprising:

(a) a filler-core formed from at least one strip of magnetic material, defining an inner surface and an outer surface and two ends which are substantially separated from each other, which is wrapped about itself so that said inner surface and said outer surface substantially overlap one another, whereby an overlapped portion is defined which has an overall thickness greater than the remaining portion of said one strip and one of said two ends is disposed along said inner surface and the other of said two ends is disposed along said outer surface;

(b) an inner strip of magnetic material, which is generally shorter in length relative to said one strip and which defines two ends, disposed at the inner surface of said one strip with both of the ends of said inner strip lying adjacent one another and with one of the ends of said inner strip abutting said one end of said one strip; and (c) an outer strip of magnetic material, which is generally shorter in length relative to said one strip and which defines two ends, disposed at the outer surface of said one strip with both of the ends of said outer strip lying abutting one another and with one of the ends of said outer strip adjacent said other end of said one strip.

6. The laminated transformer core set forth in claim 5, wherein said filler-core is formed from a first strip and a second strip of magnetic material, each of said first and second strips being generally equal in length and defining two ends, said second strip being wrapped about said first strip with one of its ends disposed adjacent and laterally separated from one end of said second strip and with the other end of said first strip disposed opposite the other end of said second strip, one of said one ends of said first strip and said second strip being disposed adjacent said one end of said outer strip and the remaining of said one ends being disposed adjacent said one end of said inner strip, whereby a wound core is formed of non-uniform cross-sectional area, with that portion of said wound core which is opposite said one end of said first strip being generally thinner than that portion of said wound core which is adjacent said one end of said first strip or that portion opposite to or adjacent said other end of said first strip.

* * * * *